US006003256A

United States Patent [19]

Leach et al.

[11] Patent Number: 6,003,256

[45] Date of Patent: Dec. 21, 1999

[54] ROLL-UP STOP/SLOW SIGN

[76] Inventors: Fred Leach, Salem, Oreg.; H. Jeanne Leach, legal representative, 4308 Buttercup Ave. NE., Salem, Oreg. 97305

[21] Appl. No.: 08/666,760

[22] Filed: Jun. 19, 1996

Related U.S. Application Data

[60] Provisional application No. 60/000,587, Jun. 27, 1995.

[51] Int. Cl.[6] ..... G09F 15/00

[52] U.S. Cl. ..... 40/610; 40/586; 116/63 P

[58] Field of Search ..... 40/586, 603, 610; 116/63 P; 160/264

[56] References Cited

U.S. PATENT DOCUMENTS

| | | | |
|---|---|---|---|
| 1,284,123 | 11/1918 | Masumian | 160/264 |
| 1,285,547 | 11/1918 | Zimmer | 160/264 |
| 1,317,579 | 9/1919 | Johnson | 160/264 X |
| 2,118,135 | 5/1938 | Baldwin . | |
| 2,887,983 | 5/1959 | Budd | 40/610 X |
| 3,899,843 | 8/1975 | Doyle et al. . | |
| 4,019,271 | 4/1977 | Latimer . | |
| 4,426,800 | 1/1984 | Brown | 40/606 |
| 4,490,934 | 1/1985 | Knapp | 40/603 |
| 4,524,533 | 6/1985 | Still, Jr. | 40/610 X |
| 4,592,158 | 6/1986 | Seely | 40/603 |
| 4,619,220 | 10/1986 | Seely et al. | 116/63 P |
| 4,888,894 | 12/1989 | Brown, Jr. | 40/606 |
| 4,980,984 | 1/1991 | Kulp et al. | 40/610 |
| 5,152,091 | 10/1992 | Leach | 40/603 |
| 5,175,646 | 12/1992 | Eden | 40/610 X |
| 5,231,778 | 8/1993 | Belobraydich et al. | 40/603 X |
| 5,551,177 | 9/1996 | Cowgill et al. | 40/586 X |

OTHER PUBLICATIONS

Advertising brochure showing previous Stop/Slow Paddle; attached to the brochure are drawings showing construction of internal support; published at least as early as Jan. 1994; author is Pacific Safety Supply, Inc.

*Primary Examiner*—Joanne Silbermann

*Attorney, Agent, or Firm*—Chernoff, Vilhauer McClung & Stenzel

[57] ABSTRACT

A collapsible sign comprises at least one flexible sheet with a first message bearing side and a second side which has at least one horizontal support member attached to the second side of the sheet. At least one vertical support member is received free of interconnection with the horizontal support members by a pocket attached to the second side of the sheet. The sign includes a fastening device detachably interconnecting the vertical support member to the pocket. After the vertical support member is removed from the pocket, the sheet may be rolled up or rolled around the vertical support member for compact storage.

1 Claim, 2 Drawing Sheets

10
18
19
STOP
16
32a
14
12
13
15

38
26
18
32a 13
14
32b
12
15

26
18
32a
14
12
15

32
30a
30d
28
SLOW
26
24
10
30b
30c
33a
14
12

ROLL-UP STOP/SLOW SIGN

This application claims the benefit of U.S. Provisional application Ser. No. 60/000,587 filed Jun. 27, 1995, and incorporates by reference the contents of such application.

BACKGROUND OF THE INVENTION

The present invention relates to a collapsible sign to provide warning messages and traffic control directions to motorists.

Collapsible signs have been used in the past to display messages, such as warning messages and traffic control directions to motorists during road construction. Leach U.S. Pat. No. 5,152,091 discloses a sign that includes a cross brace assembly having two arms pivotally connected together for pivoting between storage and display positions. Each arm has a fastener stop adjacent its ends. A flexible sign sheet has opposing message-bearing and attachment faces with four fasteners secured to the attachment face so each can slidably receive an arm end and engage its respective fastener stop when the cross brace assembly is put in the display position. Thus, during both assembly and disassembly, the arms are disadvantageously subject to the abrasive wear and stress from pivoting and flexing. The fasteners and fastener stops are difficult to engage and disengage with one another and the sign has only one message bearing side.

Thus, a need exists for an easily assemblable sign for temporary sign installations associated with road construction and traffic control.

SUMMARY OF THE INVENTION

The present invention overcomes the foregoing drawbacks of the prior art by providing an improved, inexpensive collapsible sign, that can be quickly assembled and disassembled.

The collapsible sign includes at least one flexible sheet with a first message bearing side and a second side which has at least one horizontal support member attached thereto. At least one vertical support member is attached to the second side of the sheet and received by a retaining member free of interconnection with the horizontal support members.

The sign preferably includes a fastening device detachably interconnecting the vertical support member with the retaining member. When the vertical support member is removed from the retaining member, the sheet may be rolled up or rolled around the vertical support member for storage.

The sign has the advantage of being collapsible, portable and usable repeatedly at different display locations. The support member system reduces wear characteristics by including support members that are free from interconnection with each other and are not flexed during assembly and disassembly. The sign is also suitable to display messages on both sides of the sign.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figures 1, 2, 4, 5, 6:
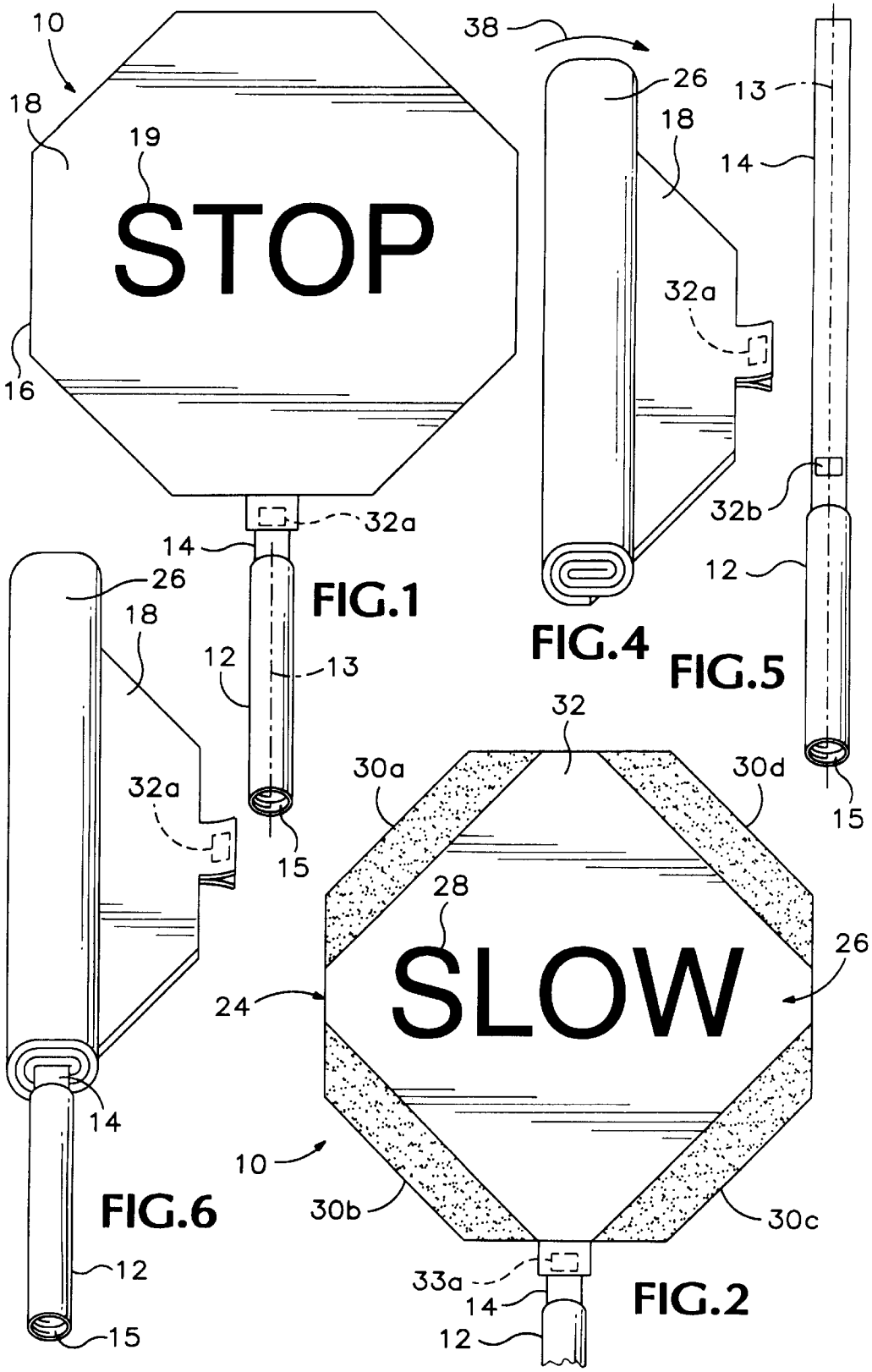
FIG. 1 is a front elevational view of an exemplary embodiment of an erected collapsible sign having a pair of sign sheets and a vertical support member.
FIG. 2 is a rear elevational view of the sign of FIG. 1.
FIG. 4 is a pictorial view of the sign sheets of FIG. 1 rolled up for storage.
FIG. 5 is a front view of the vertical support member of FIG. 1.
FIG. 6 is a pictorial view of the sign sheets of FIG. 4 rolled on the vertical support shown in FIG. 5.
Figure 3:
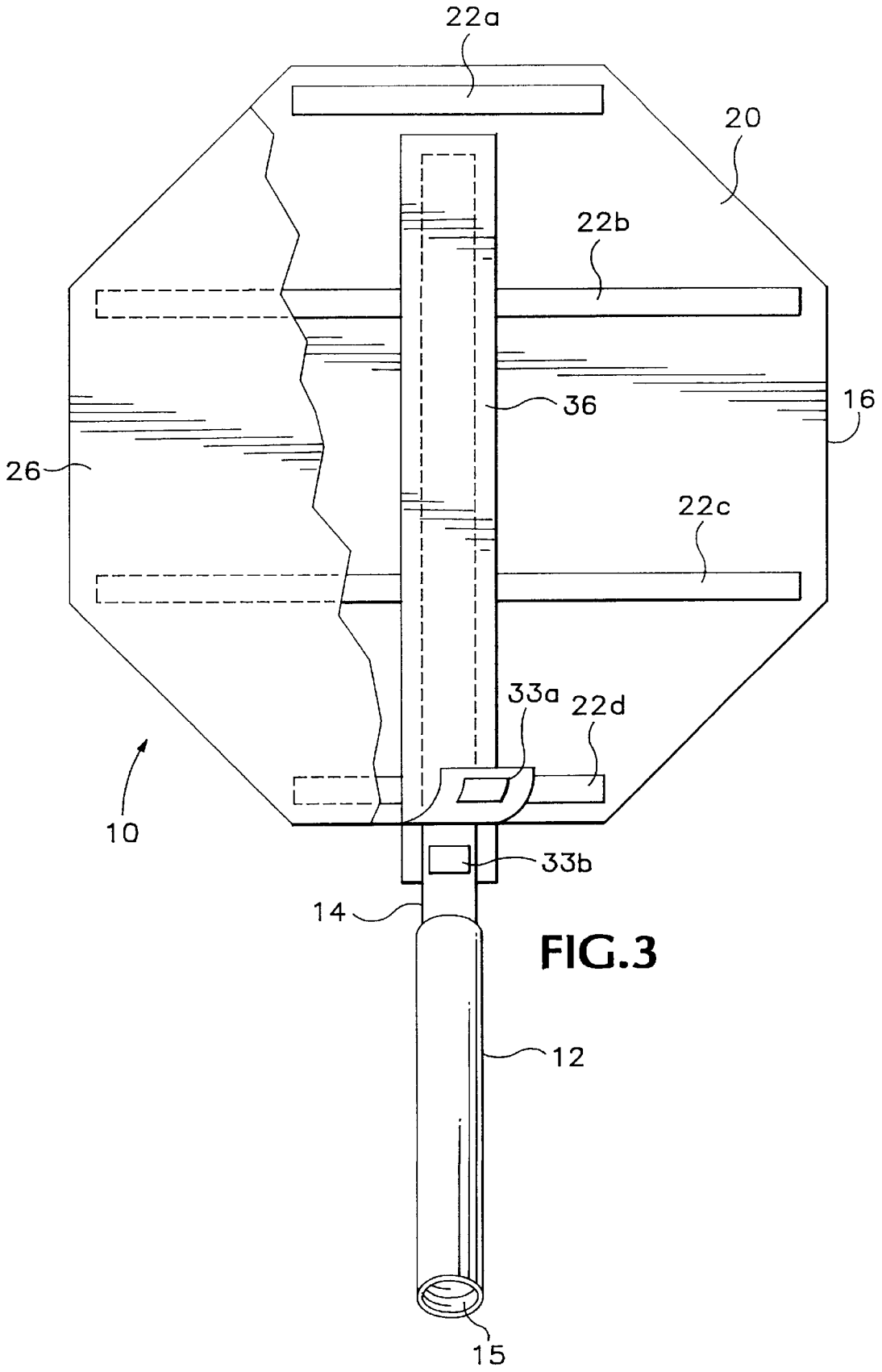
FIG. 3 is an enlarged partially cut-away view of the sign shown in FIG. 2 without a message displayed.

FIGS. 1 and 2 illustrate a collapsible sign 10 and handle 12 constructed in accordance with the present invention. The handle 12 is attached to a semi-flexible elongate vertical support member 14 that defines a longitudinal axis 13. The handle 12 may define a fastening device, such as a threaded base 15, to interconnect with a post or base. Referring also to FIG. 3, the sign 10 also includes a first flexible sheet 16 having an octagonal shaped message bearing first side 18 and an interior second side 20. The sign 10 also includes a second flexible sheet 24 with an octagonal shaped message bearing first side 26 and an interior second side.

Both sheets 16 and 24 are preferably constructed of a reflective material, although a nonreflective or a woven mesh material may be used. A suitable reflective material is available from Reflexite Corporation, of Hartford, Conn., under the trademark "REFLEXITE," a suitable nonreflective material is available from Astrup Company, of Cleveland, Ohio, under the trademark "WEBLON," and a suitable woven mesh is available from Twitchell, Inc., of Pittsburgh, Pa., under the trademark "TEXTILENE." The first message sheet 18 may have the message "STOP" imprinted thereon (see FIG. 1) and the second message sheet 24 may have the message "SLOW" imprinted thereon (see FIG. 2). Alternative messages may be used as desired. The shape of the sheets may be changed, as desired, for other suitable signs.

Foul stiff and resiliently flexible, elongate support members 22*a*, 22*b*, 22*c* and 22*d* are fixedly attached, preferably with an adhesive, to the second side 20 of the first sheet 16. The support members 22*a*–22*d* are horizontally oriented in a spaced apart relationship to each other. The support members 22*a*–22*d* resist deformation of the first sheet 16 proximate to the first support members 22*a*–22*d*, especially in a direction parallel to the support members 22*a*–22*d*. The support members 22*a*–22*d* may be constructed from any suitable fiber-reinforced plastic, wood, composite or non-composite material which has some elastic flexure properties that allow the support members 14 and 22*a*–22*d* to bend slightly. The flexibility permits the sign 10 to flex and yield to wind during use in order to off-load wind from the sign.

Referring again to FIG. 3, the sign includes a retaining member in the form of a flexible vertical pocket 36 attached to the second side 20 of the first sheet 16 and sized to receive the vertical support member 14 therein. The vertical support member 14 is retained in the pocket 36, free from interconnection with the horizontal support members 22*a*–22*d* so that the first sheet 16 assumes a substantially flat configuration when the support member 14 is received by the retaining member. The retaining member includes two elongate strips of flexible sheet material attached to the second side 20 of the first sheet to form the pocket 36. The retaining member may also be any other suitable structure, such as loops, fasteners, and hook and loop fabric fasteners, such as those sold under the trademark VELCRO, that secures the first sheet 16 to the vertical support member 14.

Referring again to FIGS. 2 and 3, the second sheet 24 has a dark border on its diagonal margins, which creates an appearance of a light, generally square background 32 upon which the message "SLOW" is displayed. The first sheet 20 is attached to the second sheet 24 along their margins, except for an opening in which to insert the vertical support member 14, by an adhesive or by being sewn.

Referring to FIGS. 1–5, to secure the sheets 16 and 24 to the vertical support member 14, fastening devices 32*a*, 32*b*, 33*a* and 33*b* detachably interconnect the vertical support member 14 and the respective sheets 16 and 24 so as to resist relative movement of the sheets 16 and 24 with respect to the vertical support member 14. The fastening devices 32*a*–32*b* and 33*a*–33*b* include respective fastener portions which are preferably hook and loop fabric fasteners, such as those sold under the trademark VELCRO. The fastening devices may be other configurations, as will be apparent to those skilled in the art.

After use, the sign 10 is prepared for storage, as illustrated in FIGS. 4–6. To disassemble the sign 10 the fastening devices 32*a* and 33*a* are disengaged from the fastening devices 32*b* and 33*b*, respectively, by lifting the fastening devices 32*a* and 33*a* from their mating parts 32*b* and 33*b*, and the vertical support member 14 is slidably removed from the retaining member 36. Referring to FIG. 4, the sheets 16 and 24 are then rolled up in the direction indicated by arrow 38. Alternatively, the sign 10 may be rolled up around the vertical support member 14, as shown in FIG. 6. It is apparent that these steps may be reversed to erect the sign 10 from the storage configurations of FIGS. 4 and 6.

The sign 10 has many advantages, some of which are mentioned above. Furthermore, the sign 10 may be assembled and disassembled without requiring additional tools or hardware. Bending the support members is not required during assembly or disassembly, eliminating stress placed on the support members. The rapid deployment and preparation for storage of the sign 10 saves labor and time. The compact, neat storage of the sign 10 shown in FIG. 6 protects the sign during transportation between job sites, as well as during storage. Additionally, manufacturing the sign 10 of substantially electrically non-conducting materials provides a sign assembly which is particularly useful for electrical utilities. Additionally, the sign 10 has enhanced resistance to corrosion from the elements, such as rain, salt spray and the like, in contrast to signs with exposed support members.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A collapsible sign capable of being rolled up for storage, comprising:

(a) a first flexible sheet having a message bearing side and a second side;

(b) at least one resiliently flexible elongate first support member attached to said second side of said first sheet;

(c) at least one resiliently flexible elongate second support member;

(d) at least one retaining member attached to said second side of said first sheet to receive said at least one second support member free from interconnection with said first support member so that said first sheet assumes a substantially flat configuration when said at least one second support member is received by said at least one retaining member; and (e) at least one fastening device comprising first and second releasable fastening members, said first releasable fastening member being supported by said retaining member and said second releasable fastening member being supported by said at least one second support member, said fastening device detachably interconnecting said at least one second support member with at least one of said retaining member and said first sheet so as to resist relative movement of said first sheet with respect to said at least one second support member.

* * * * *